United States Patent [19]

Schulz

[11] Patent Number: 4,577,889

[45] Date of Patent: Mar. 25, 1986

[54] BAG BOOK

[76] Inventor: Judith D. Schulz, 212 S. Fourth St., Delavan, Wis. 53115

[21] Appl. No.: 602,600

[22] Filed: Apr. 20, 1984

[51] Int. Cl.[4] ..... B42D 5/00; B42D 13/00; B31B 1/90; B31B 1/60

[52] U.S. Cl. ..... 281/15 R; 281/1; 281/3 R; 493/218; 493/220

[58] Field of Search ..... 281/1, 2, 3 R, 15 R, 281/21 A, 31, 38; 383/42; 493/186, 217, 218, 220, 219

[56] References Cited

U.S. PATENT DOCUMENTS

| | | | |
|---|---|---|---|
| 1,549,832 | 8/1925 | Hartmann | 493/220 |
| 1,672,608 | 6/1928 | Friedman | 281/3 R |
| 1,782,884 | 11/1930 | Royal | 493/220 |
| 2,330,311 | 9/1943 | Pierce | 493/217 |
| 2,572,460 | 10/1951 | Falk | 281/1 |
| 2,629,382 | 2/1953 | Gomez | 281/21 A |
| 2,686,049 | 8/1954 | Hollingsworth | 281/2 |
| 3,260,170 | 7/1966 | Barraclough | 493/186 |
| 3,351,064 | 11/1967 | Cohn . | |
| 3,434,227 | 3/1969 | Brown, Jr. . | |
| 3,797,146 | 3/1974 | Holes . | |
| 3,924,521 | 12/1975 | Hanson et al. | 493/218 |
| 4,055,008 | 10/1977 | Bell | 281/31 |

*Primary Examiner*—Paul A. Bell
*Assistant Examiner*—Paul M. Heyrana, Sr.
*Attorney, Agent, or Firm*—Andrus, Sceales, Starke & Sawall

[57] ABSTRACT

A bag book (2) is provided by a plurality of bags (4) bound together at binding (8) along an edge (20) to provide a book. Each bag forms a page of the book and provides a pocket (14) in the interior of the bag. The bags are folded upwardly to define one or more upwarding facing edges (24, 40) prior to binding, to form auxiliary pockets (26, 52) for additional retention of items.

18 Claims, 8 Drawing Figures

BAG BOOK

BACKGROUND AND SUMMARY

The invention relates to scrap books, collector books, and the like.

The invention provides a book with a plurality of pages having pockets into which are tucked items to be saved, such as awards, art work, certificates, confidential papers, recordings of events, ideas and plans, photographs, newspaper clippings, messages and notes, letters and mail, maps, school work, souvenirs, keepsakes, writings, programs, birthday cards, receipts, pamphlets and numerous other items.

The invention is particularly characterized in its simplicity of construction and use of standard readily available inexpensive materials. Like traditional scrap books, collected items may be glued or pasted into the book. Additionally, collected items are inserted into pockets. The book is expandable without adding extra pages because the pages and pockets expand to accommodate quantities of items and thicker items than otherwise accommodated by traditional scrap books or pocketed photoalbums or the like. This pocket expansion capability also enables additional items to be collected beyond those normally saved in traditional scrap books or pocketed photoalbums, for example three dimensional items, such as small kits, magnifying glasses, pencil collections, instruction manuals, small tools, paperback books, children's books, booklets, children's phonograph records, casette tapes, and so on.

The book further facilitates and encourages the collecting and saving of items due to the ease and facility of item storage provided thereby. This characteristic is particularly desirable because it minimizes user efforts otherwise deterring the saving and collecting of valuable momentos. The present invention provides a simple, efficient, and minimal user effort system for collecting and storing such momentos. This in turn fosters increased retention of valuable momentos, and greater subsequent enjoyment thereof.

DETAILED DESCRIPTION

Figure 1:
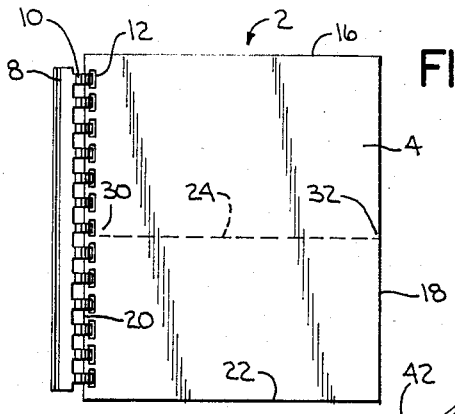
FIG. 1 is a front elevation view of a book constructed in accordance with the invention.
Figure 2:
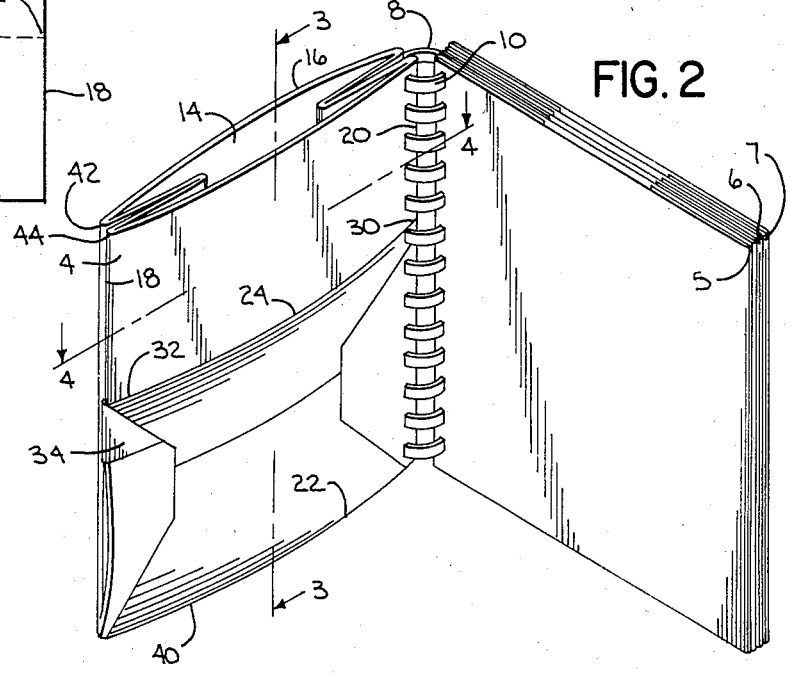
FIG. 2 is an isometric view of an open condition of the book of FIG. 1.

FIGS. 1 and 2 show a bag book 2 comprising a plurality of bags such as 4–7 bound together along an edge to provide a book. In the embodiment shown, the binder 8 is in the form of a plastic ring binder having a plurality of rings such as 10 extending through apertures such as 12 in the bags. Each bag forms a page of the book and provides a pocket such as 14 in the interior of the bag.

Figure 3:
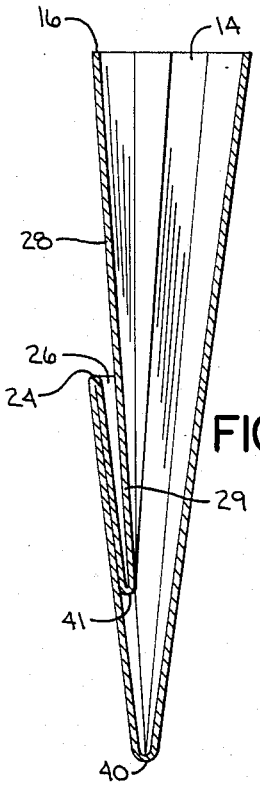
FIG. 3 is a cross sectional view taken along line 3—3 of FIG. 2.
Figure 4:
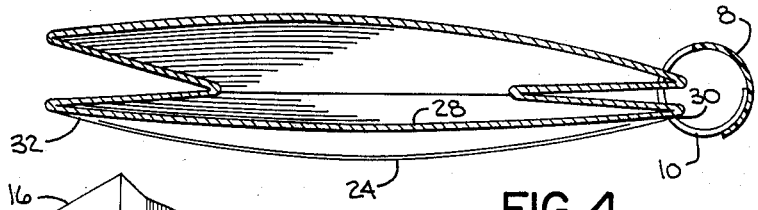
FIG. 4 is a cross sectional view taken along line 4—4 of FIG. 2.

Each bag is open at the top end such as 16 and is closed at the right, left and bottom edges 18, 20 and 22, respectively, and is bound at left edge 20. The bags are folded upwardly to define an upwardly facing edge 24, FIG. 3, prior to binding to form an auxiliary pocket 26 between upwardly facing edge 24 and the body 28 of the bag. Each bag page thus has two pockets 14 and 26. The left end 30 of upwardly facing edge 24 is bound with left bag edge 20 in binding 8. The right end 32 is fastened to right bag edge 18 to form auxiliary pocket 26. This fastening is by means of adhesive tape 34, glue, a clip, crimping, string, wire, a staple, or the like.

Figure 5:
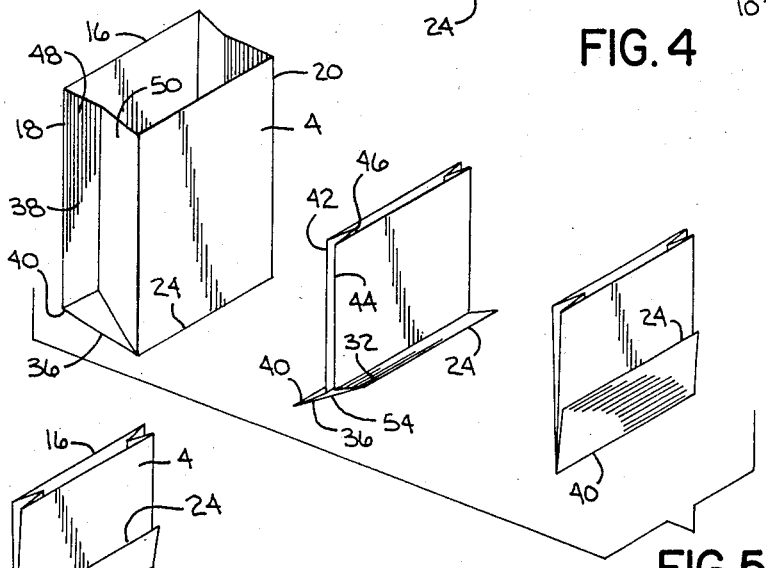
FIG. 5 is an assembly sequence view illustrating folding of a bag to form a page of the book of FIG. 2.

In the embodiment shown in FIGS. 1–5, bag 4 is of the flat bottom type having a bottom horizontal wall 36, FIG. 5, of left-right and forward-rearward horizontal extension, and having side bellows such as 38 in the left and right edges 20 and 18 enabling forward-rearward expansion. Rearward edge 24 of bottom horizontal wall 36 is folded upwardly, FIG. 5, to form upwardly facing edge 24 and auxiliary pocket 26. In the embodiment shown in FIGS. 1–5, forward edge 40 of bottom wall 36 is the bottom edge of main pocket 14 in the open top of the bag. In this embodiment, edge 24 is folded upwardly to a point below open top 16 of the bag such that auxiliary pocket 26 is shallower than main pocket 14 in the bag. The bottom of auxiliary pocket 26 is formed by crease 41 in the bag rearward vertical wall 29. Crease 41 is vertically spaced above edge 40. Side bellows 38 is formed by a pair of outer creases 42 and 44, FIG. 5, and an inner crease 46 with sheet-like bag side wall sections 48 and 50 therebetween. The right end 32 of upwardly facing edge 24 is fastened only to outer crease 44 adjacent thereto, to enable expansion of inner crease 46 and the other outer crease 42 away from crease 44.

Figure 6:
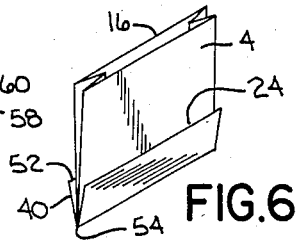
FIG. 6 shows an alternate embodiment of a page of the book of FIG. 2.

In an alternate embodiment, forward edge 40 of bottom wall 36 is folded upwardly, FIG. 6, to form a second upwardly facing edge 40 and a second auxiliary pocket 52 on the front side of bag 4, opposite auxiliary pocket 26 on the rear side of bag 4 formed by upwardly facing rear edge 24. In this embodiment, a main pocket 14 is provided, with two auxiliary pockets 26 and 52 on opposite sides thereof, each of the auxiliary pockets being shallower than the main pocket but having a bottom pocket edge 54, FIG. 6, at the same vertical level as the main pocket. Edge 54 is the center of bottom wall 36, FIG. 5, of a flat bottom bag.

Figure 7:
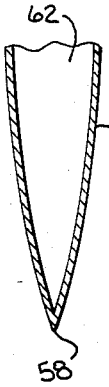
FIG. 7 is a sectional view showing an alternate bag embodiment for a page of the book of FIG. 2.
Figure 8:
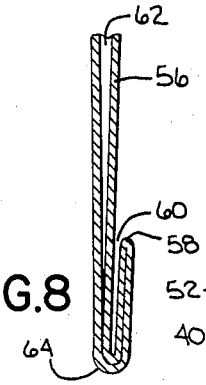
FIG. 8 is a sectional view showing a folded condition of the bag of FIG. 7.

FIGS. 7 and 8 show a bag 56 of the crease bottom type as at crease 58 having left-right extension, but no forward-rearward extension. The left and right edges of the bag may have side bellows enabling forward-rearward expansion, the side bellows being formed by a pair of outer creases and an inner crease with sheet-like bag side wall sections therebetween, comparably to that above described. Bag 56 is folded upwardly to define upwardly facing edge 58, FIG. 8, prior to binding, to form auxiliary pocket 60 between upwardly facing edge 58 and the body of bag 56, such that the bag page formed by bag 56 has two pockets, main pocket 62 and auxiliary pocket 60. Alternatively, bag 56 may be bound without folding the bottom crease upwardly, yielding a single pocket 62 per bag.

It is thus seen that there is provided a bag book 2 constructed in one embodiment of standard paper grocery bags such as 4 or 56, for example comprising a plurality of bags such as 4 each open at the top 16, and closed at bottom 22 and left and right edges 20 and 18. The left and right edges have side bellows such as 38 enabling forward-rearward expansion. The bottom edge of the bag is folded upwardly to define an upwardly facing edge 24 forming an auxiliary pocket 26 in addition to main pocket 14 in the open top 16 of the bag. The bottom of the main pocket of the bag is the bottom crease such as 40, 54, or 64 in the bag after upward folding. The bags are bound together along left edge 20, including left end 30 of upwardly facing edges such as 24 and 58.

It is recognized that various modifications are possible within the scope of the appended claims.

I claim:

1. A bag book comprising a plurality of bags bound together along an edge to provide a book, each bag forming a page of said book and providing a pocket in the interior of said bag;

wherein each said bag is open at the top and is closed at the right, left and bottom edges, and is bound at said left edge;

wherein said bags are folded upwardly to define an upwardly facing edge prior to binding, to form an auxiliary pocket between said upwardly facing edge and the body of the bag, such that each bag page comprises two pockets.

2. The invention according to claim 1 wherein one end of said upwardly facing edge is bound with said left bag edge in said binding, and wherein the other end of said upwardly facing edge is fastened to said right bag edge, to form said auxiliary pocket.

3. The invention according to claim 2 wherein said bag is of the flat bottom type having a bottom horizontal wall of left-right and forward-rearward horizontal extension, and wherein said upwardly facing edge is folded upwardly to a point below said open top of said bag such that said auxiliary pocket is shallower than said pocket in said bag.

4. The invention according to claim 2 wherein said bag is of the flat bottom type having a bottom horizontal wall of left-right and forward-rearward horizontal extension, and having side bellows in said left and right edges enabling forward-rearward expansion, and wherein one of the forward and rearward edges of said bottom horizontal wall is folded upwardly to form an upwardly facing edge and auxiliary pocket, and the other of the forward and rearward edges of said bottom wall is the bottom edge of the main pocket in the open top of said bag.

5. The invention according to claim 4 wherein said side bellows is formed by a pair of outer creases and an inner crease with sheet-like bag side wall sections therebetween, and wherein said other end of said upwardly facing edge is fastened only to the outer crease adjacent thereto, to enable expansion of the inner crease and the other outer crease away therefrom.

6. The invention according to claim 2 wherein said bag is of the flat bottom type having a bottom horizontal wall of left-right and forward-rearward horizontal extension, and having side bellows in said left and right edges enabling forward-rearward expansion, and wherein the rearward edge of said bottom horizontal wall is folded upwardly to form a rearward said upwardly facing edge and a first auxilliary pocket, and the forward edge of said bottom wall is folded upwardly to form a forward upwardly facing edge and a second auxiliary pocket.

7. The invention according to claim 6 wherein the main pocket in said bag and each of said first and second auxiliary pockets on opposite sides thereof have a bottom edge at substantially the same vertical level.

8. The invention according to claim 2 wherein said bag is of the crease bottom type having left-right extension, but no forward-rearward extension.

9. The invention according to claim 8 wherein said left and right edges of said bag have side bellows enabling forward-rearward expansion, said side bellows being formed by a pair of outer creases and an inner crease with sheet-like bag side wall sections therebetween, and wherein said other end of said upwardly facing edge is fastened only to the outer crease adjacent thereto, to enable expansion of the inner crease and the other outer crease away therefrom.

10. A bag book constructed of standard paper grocery bags comprising a plurality of bags each open at the top, and closed at the bottom, left and right edges, said left and right edges having side bellows enabling forward-rearward expansion, the bottom edge of the bag being folded upwardly to define an upwardly facing edge forming an auxiliary pocket in addition to a main pocket in the open top of the bag, the bottom of the main pocket being the bottom crease in the bag after said upward folding, said bags being bound together along said left edge, including the left end of said upwardly facing edge, the right end of said upwardly facing edge being fastened to said bag edge to form said auxiliary pocket.

11. The invention according to claim 10 wherein at least one of said bags is of the flat bottom type and wherein the bottom of said auxiliary pocket is vertically spaced above the bottom of said main pocket.

12. The invention according to claim 11 wherein said bag has a bottom horizontal wall of left-right and forward-rearward extension, the bottom of said main pocket being formed by one of the forward and rearward edges of said bottom horizontal wall, the other of the forward and rearward edges of said bottom horizontal wall providing said upwardly facing edge, the bottom of said auxiliary pocket being formed by a crease in one of the bag forward and rearward vertical walls, said last mentioned crease being vertically spaced above said one of said forward and rearward edges of said bottom horizontal wall.

13. The invention according to claim 10 wherein at least one of said bags is of the flat bottom type and wherein the bottom of said auxiliary pocket is at substantially the same vertical level as the bottom of said main pocket.

14. The invention according to claim 13 wherein said bag has a bottom horizontal wall of left-right and forward-rearward extension, the bottom of said main pocket being formed by the center of said forward-rearward flat bottom wall, the bottom of said auxiliary pocket being formed by a crease in the bag rearward vertical wall due to upward folding of said rearward edge of said bottom horizontal wall, a second auxiliary front pocket being formed by a crease in the bag forward vertical wall due to upward folding of the forward edge of said bottom horizontal wall.

15. The invention according to claim 10 wherein at least one of said bags is of the crease bottom type and wherein the bottom of said auxiliary pocket is substantially at the same vertical level as the bottom of said main pocket.

16. A book comprising a plurality of pages bound together, each page having front and rear walls and left and right side walls, said left and right side walls having bellows therein enabling forward-rearward expansion, each said bellow being formed by a pair of outer creases and an inner crease with sheet-like side wall sections therebetween, the bottom of said page being folded upwardly, the left edge of said page being bound with the other said pages by binding means attached to each of said outer creases of said left edge and to each of said outer creases of the upwardly folded portion of said left edge, and means fastening only one of said outer creases of said right edge to the upwardly folded portion of said right edge adjacent thereto, such that said inner crease and said other outer crease of said right edge are free to expand away from said one outer crease of said right edge.

17. The invention according to claim 16 wherein said one outer crease of said right edge is fastened to at least one outer crease of said upwardly folded portion of said right edge.

18. The invention according to claim 17 wherein said one outer crease of said right edge is fastened to said at least one outer crease of said upwardly folded portion of said right edge only at the top of the latter.

* * * * *